US009410109B1

(12) United States Patent
Kozyuk

(10) Patent No.: US 9,410,109 B1
(45) Date of Patent: Aug. 9, 2016

(54) METHODS FOR DEGUMMING OILS

(71) Applicant: ARISDYNE SYSTEMS, INC., Cleveland, OH (US)

(72) Inventor: Oleg Kozyuk, North Ridgeville, OH (US)

(73) Assignee: ARISDYNE SYSTEMS, INC., Cleveland, OH (US)

( * ) Notice: Subject to any disclaimer, the term of this patent is extended or adjusted under 35 U.S.C. 154(b) by 0 days.

(21) Appl. No.: 15/099,930

(22) Filed: Apr. 15, 2016

Related U.S. Application Data

(63) Continuation of application No. 14/323,004, filed on Jul. 3, 2014, now Pat. No. 9,321,983.

(51) Int. Cl.
*C11B 3/00* (2006.01)
*C11B 3/04* (2006.01)
*C11B 3/06* (2006.01)

(52) U.S. Cl.
CPC .... *C11B 3/04* (2013.01); *C11B 3/06* (2013.01)

(58) Field of Classification Search
CPC ..... C11C 3/04
USPC ..... 554/204
See application file for complete search history.

(56) References Cited

U.S. PATENT DOCUMENTS 5,239,096 A 8/1993 Rohdenburg et al.
5,696,278 A 12/1997 Segers
5,717,181 A 2/1998 Colgate
5,931,771 A 8/1999 Kozyuk
5,937,906 A 8/1999 Kozyuk
6,012,492 A 1/2000 Kozyuk
6,035,897 A 3/2000 Kozyuk
7,135,155 B1 11/2006 Long, Jr. et al.
7,935,157 B2 5/2011 Kozyuk et al.
9,045,712 B2 6/2015 Dayton et al.
2005/0143590 A1 6/2005 Dawson
2009/0306419 A1 12/2009 Myong et al.
2009/0314688 A1 12/2009 Gordon et al.
2011/0003370 A1 1/2011 Gordon et al.
2012/0181216 A1 7/2012 Kozyuk et al.
2013/0011887 A1 1/2013 Dayton et al.

(Continued)

FOREIGN PATENT DOCUMENTS

CA 2644085 A1 9/2007
RU 2288948 12/2006

(Continued)

OTHER PUBLICATIONS

Gogate, et al., "A Review and Assessment of Hydrodynamic Cavitation as a Technology for the Future", 2005, Ultrasonics Sonochemistry 12, 21-27, Elsevier.

(Continued)

*Primary Examiner* — Deborah D Carr
(74) *Attorney, Agent, or Firm* — Pearne & Gordon LLP

(57) ABSTRACT

Processes and systems are provided for effectively degumming vegetable oils with the use of an acid and base pretreated mixture of vegetable oil. The pretreated mixture is subjected to compression and one or more intervals of explosive decompression of the compressed mixture to form a degummed vegetable oil. Also provided are compression and decompression rates and conditions that can be used to effectively degum vegetable oil to achieve reduced levels of phosphorus and metals such as iron, calcium and magnesium.

16 Claims, 1 Drawing Sheet

(56) References Cited

U.S. PATENT DOCUMENTS

| | | | |
|---|---|---|---|
| 2013/0062249 | A1 | 3/2013 | Kozyuk et al. |
| 2014/0371476 | A1 | 12/2014 | Dayton et al. |

FOREIGN PATENT DOCUMENTS

| | | | | |
|---|---|---|---|---|
| RU | 2333942 | | 9/2008 | |
| WO | 2011046815 | A1 | 4/2011 | |
| WO | WO 2011046815 | A1 * | 4/2011 | ..... C10L 1/026 |

OTHER PUBLICATIONS

Gogate, et al., "Cavitation: A Technology on the Horizon", Jul. 10, 2006, Current Science, vol. 91, No. 1.

Gogate, et al., "Engineering Design Methods for Cavitation Reactors II: Hydrodynamic Cavitation, AIChE Journal", Aug. 2000, vol. 46, No. 8.

Kumar, et al., "Experimental Quantification of Chemical Effects of Hydrodynamic Cavitation", Chemical Engineering Science, 2000, 55, 1633-1639, Pergamon, Elsevier Science Ltd.

Pandit, et al., "Improve Reactions with Hydrodynamic Cavitation", On the Horizon, 1999, Chemical Engineering Progress.

Moulton, et al., "Continuous Ultrasonic Degumming of Crude Soybean Oil", 1990, JAOCS, vol. 67, No. 1.

The International Search Report and Written Opinion issued in International PCT Application No. PCT/US2014/045356; Date of Mailing: Mar. 13, 2015.

* cited by examiner

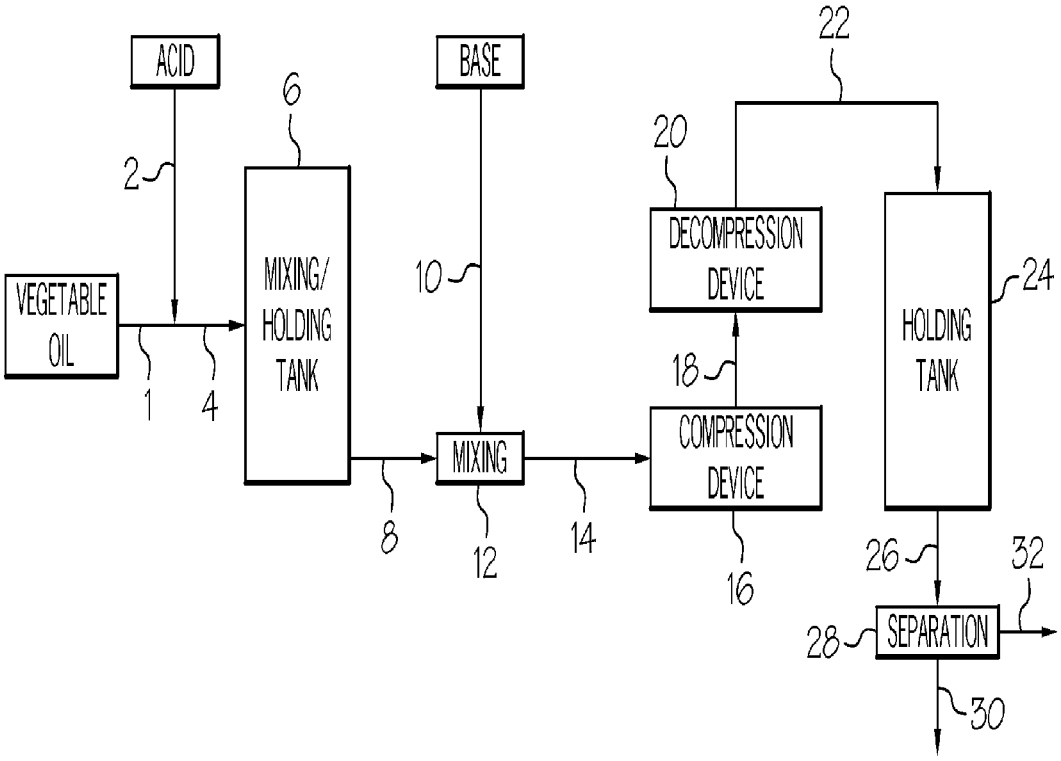
ACID
BASE
VEGETABLE OIL
MIXING/ HOLDING TANK
MIXING
DECOMPRESSION DEVICE
COMPRESSION DEVICE
HOLDING TANK
SEPARATION
1
2
4
6
8
10
12
14
16
18
20
22
24
26
28
30
32

METHODS FOR DEGUMMING OILS

This application claims priority of U.S. patent application Ser. No. 14/323,004, filed Jul. 3, 2014.

FILED

The present invention relates to methods for improving the refining of oils, and in particular, to improving the degumming of vegetable oils having free fatty acids ad phospholipids.

BACKGROUND

Vegetable oils are generally pressed or extracted oil from a vegetable source. Vegetable oils can contain phospholipids, commonly known as gums, which can be hydratable or non-hydratable. For example, the following oils can contain gums, in weight percent, soybean 1 to 3, corn 0.6 to 0.9, sunflower oil 0.5 to 0.9 and canola oil (crude) 1 to 3. Gums can be partially removed from vegetable oils through know degumming processes, such as water degumming, acid degumming, caustic refining and enzymatic degumming. Such processes can be found in U.S. Pat. Nos. 4,049,686; 5,239,096; 5,264,367; 5,286,886; 6,001,640; 6,033,706; 7,494,676 and 7,544,820. Further references include U.S. Pat. App. Pub. Nos. 2007/0134777; 2008/0182322 and 2012/0258017.

Other degumming processes include high shear mixers, for example, the processes disclosed in U.S. Pat. Nos. 4,240,972; 4,698,185; 6,172,248 and 8,491,856. It has been proposed to refine vegetable oil using cavitation, such as that disclosed in U.S. Pat. App. Pub. Nos. 2009/0314688; 2011/0003370 and 2014/0087042.

The existing methods are not sufficient to efficiently remove non-hydratable phospholipids present in the oil because the non-hydratable phospholipids are not available to be hydrated or reacted to enable their removal. Thus, there is a need for alternative degumming processes for treating vegetable oil that can provide cost-effective removal of phosphorous, preferably to levels of 5 ppm to 10 ppm or below, depending on applications, and of metallic impurities such as calcium, magnesium and/or iron. The present invention focuses on such process for degumming vegetable oils.

SUMMARY

The present invention provides a process for hydrating the non-hydratable phospholipids in vegetable oil. A vegetable oil is mixed with an acid to form an emulsion. The emulsion can be mixed with a base to form a pretreated mixture. The pretreated mixture can have emulation droplets containing an acid and base. The process includes compressing the pretreated mixture to reduce the volume of the droplets containing an acid and the droplets containing base to form of compressed mixture. The compressed mixture is explosively decompressed in a decompression step. The explosive decompression of the compressed mixture is carried out in the range of $1\times10^5$ MPa per second to about $3\times10^6$ MPa per second. The decompression step causes the droplets containing the acid and the base to burst and form smaller droplets containing an acid and droplets containing a base.

In one embodiment, the process can include subjecting the pretreated mixture to a compression step and at least two decompression step intervals. The decompression step intervals can be each carried out at a decompression rate in the range of $1\times10^5$ MPa per second to about $3\times10^6$ MPa per second.

In another embodiment, the explosive decompression can be carried out at a decompression rate such that cavitation bubbles are not formed, for example, in the range of $1\times10^5$ MPa per second to about $3\times10^6$ MPa per second.

In another embodiment, the explosive decompression can be carried out at a decompression rate such that the compressed mixture remains in entirely liquid form during the explosive decompression.

In another embodiment, the pretreated mixture can be compressed to a level of at least 3 MPa and the volume of the droplets containing an acid and base can be reduced by at least 0.1%.

In another embodiment, the device used to compress the pretreated mixture can be a plunger, centrifugal or gear pump. The device used to decompress the compressed mixture can be a throttle device, such as an orifice, nozzle or pressure loss fluid control device, which can be adjustable or non-adjustable.

In a further embodiment, the process can include multiple compression and decompression devices, the compression and decompression devices can be positioned in series to form a consecutive compression and decompression intervals for processing the pretreated mixture. Alternatively, the compression and decompression devices can be arranged in parallel for processing the pretreated mixture.

In yet another embodiment, the vegetable oil can be a crude oil or a previously water degummed oil.

The present invention provides a vegetable oil degumming system. The system can include a tank for mixing a vegetable oil and an acid to form an emulsion and a base tank. The base from the base tank can be mixed with the oil and acid emulsion to form a pretreated mixture. The system further includes a compression device having an inlet for receiving the pretreated mixture. The compression device is capable of compressing the pretreated mixture to form a compressed mixture having a pressure of at least 3 MPa. The system further includes a decompression device having an inlet for receiving the compressed mixture. The decompression device is capable of decompressing the compressed mixture at a rate in the range of $1\times10^5$ MPa per second to about $3\times10^6$ MPa per second without subjecting the mixture to cavitation to form a degummed vegetable oil.

In an embodiment, the system can include a pre-filter device for filtering the pretreated mixture prior to compression with the compression device. The pre-filter device can be connected to the inlet of the compression device.

In another embodiment, the device used to compress the pretreated mixture can be a plunger, centrifugal or gear pump. The device used to decompress the compressed mixture can be a throttle device, such as an orifice, nozzle or pressure loss fluid control device, which can be adjustable or non-adjustable.

BRIEF DESCRIPTION OF THE DRAWINGS

The following figures illustrate various aspects of one or more embodiments of the present invention, but are not intended to limit the present invention to the embodiments shown.

FIG. 1 shows a process for degumming vegetable oil by use of compression and decompression steps.

DETAILED DESCRIPTION

As used herein, when a range such as 5-25 is given, this means at least or more than 5 and, separately and independently less than or not more than 25.

The present invention relates to processes and systems for degumming vegetable oils, such as plant-derived oils. The processes and systems use the energy released from explosive decompression to achieve effective degumming of vegetable oils, which allows for the removal of phospholipids, metals and other impurities.

Turning to FIG. 1, a vegetable oil 1 and an acid 2 can be mixed 4 in a mixing or holding tank 6 to form an acid in oil emulsion 8. The vegetable oil 1 can be any oil derived, produced or extracted from a vegetable, seed or vegetable plant, such as acai oil, almond oil, babassu oil, blackcurrent seed oil, borage seed oil, canola oil, cashew oil, castor oil, coconut oil, coriander oil, corn oil, cottonseed oil, *crambe* oil, flax seed oil, grape seed oil, hazelnut oil, hempseed oil, jatropha oil, jojoba oil, linseed oil, macadamia nut oil, mango kernel oil, meadowfoam oil, mustard oil, neat's foot oil, olive oil, palm oil, palm kernel oil, palm olein, peanut oil, pecan oil, pine nut oil, pistachio oil, poppy seed oil, rapeseed oil, rice bran oil, safflower oil, sasanqua oil, sesame oil, shea butter, soybean oil, sunflower seed oil, tall oil, tsubaki oil walnut oil. The vegetable oil can be in any condition, for example, the vegetable oil can be crude, refined, pressed, extracted, filtrated, dewatered or water degummed.

The vegetable oil 1 can have a phosphorus content in the range of 15 to 1,200 ppm. For example, a crude vegetable oil can have a phosphorus content in the range of 200-1,200 ppm whereas a water degummed vegetable oil can have a lower phosphorus content in the range of 15 to 200 ppm. The processes and systems described herein can reduce the phosphorus content of the vegetable oil, for instance, the phosphorus content can be reduced by at least 50, 60, 70, 80, 85, 90, 92.5, 95, 96, 97, 98 or 99 percent.

The acid 2 can be added to the vegetable oil to aid in the hydration of the non-hydratable phospholipids. The acid 2 can be organic or inorganic, for example, phosphoric acid, hydrochloric acid, sulfuric acid, ascorbic acid, acetic acid, citric acid, fumaric acid, maleic acid, tartaric acid, succinic acid, glycolic acid or any combination thereof. The acid is preferably added to the vegetable oil in an aqueous solution. For example, the aqueous acid can have any concentration of acid such that when added to the vegetable oil the acid content, excluding the water, is at least 0.005 weight percent of the total weight of the oil. The amount of aqueous acid added to the vegetable oil can be in the range of 0.1 to 0.3 weight percent of the oil. The aqueous acid can have an acid concentration of 50 to 90 weight percent or 60, 70, 80 or 85 weight percent acid.

The vegetable oil 1 and acid 2 can be combined 4 in line by a static mixer or the like or be combined or individually added to a mixing tank 6 to form an acid in oil emulsion as known in the art. The emulsion 8 can have droplets in the vegetable oil. The droplets can contain water and acid.

The emulsion 8 can be combined with a base 10 to form a pretreated mixture 14. A base 10 can be added to achieve neutralization of free fatty acids in the vegetable oil. The base 10 can be sodium hydroxide, potassium hydroxide, sodium silicate, sodium carbonate, calcium carbonate, or any combination thereof. The base is preferably added to the emulsion 8 in an aqueous solution. For example, the aqueous base can have any concentration of base such that when added to the emulsion the base content, excluding the water, is at least 0.005 weight percent of the total weight of the vegetable oil. The amount of aqueous base added to the emulsion 8 can be in the range of 0.1 to 0.5 weight percent of the oil. The aqueous base can have an base concentration of 1 to 30 weight percent or 5, 10, 15, 20 or 25 weight percent base.

The emulsion 8 and base 10 can be combined in line by a static mixer or the like or be combined or individually added to a mixing apparatus 12, such as a mixing tank, to form a pretreated mixture 14. The pretreated mixture 14 can have droplets in the vegetable oil. The droplets can contain water and acid, water and base or a combination of water, acid and base.

The pretreated mixture 14 can be processed at a temperature in the range of 20 to 100° C., or 30, 40, 50, 60, 70, 80 or 90° C. Preferably, the pretreated mixture is maintained at a processing temperature in the range of 40 to 95° C.

The pretreated mixture 14 is subjected to a compression step. The compression step can include passing the pretreated mixture 14 through a compression device 16 to form a compressed pretreated mixture 18. The compression device 16 can include, for example, a pump, such as a plunger, centrifugal or gear pump. The compression device 16 can increase the pressure of the pretreated mixture 14 to at least 3 MPa to form the compressed pretreated mixture 18. For example, the pressure of the pretreated mixture 14 can be increased to a pressure in the range to 3 to 10 MPa, or 3.5, 4, 4.5, 5, 6, 7, 8 or 9 MPa.

The compressed pretreated mixture 18 is subjected to a decompression step. Preferably, the decompression step, or multiple decompression steps, operates to degum the compressed pretreated mixture 18. The decompression step can include passing the compressed pretreated mixture 18 through a decompression device 20. The decompression device 20 can include, for example, a throttling device, which can be adjustable or non-adjustable, a local constriction, an orifice, pressure loss fluid control valve, nozzle, baffle or aperture. In one embodiment, the orifice or nozzle can have an opening diameter less than or equal to 2 mm, or preferably less than or equal to 0.5 mm. The decompression device 20 can have a sharp edged or squatted edge surface for creating more shear and at a reduced pressure drop time.

The decompression device 20 can decompress or reduce the pressure in the compressed pretreated mixture 18 at a rate in the range of $1\times10^5$ MPa per second to about $3\times10^6$ MPa per second. The pressure drop created by the decompression device can be in the range of 0.1 to 3 MPa, or at least 0.2, 0.4, 0.6, 0.8, 1, 1.2, 1.4, 1.6, 1.8, 2, 2.2, 2.4, 2.6 or 2.8 MPa. The decompression device reduces the volume of the compressed droplets containing acid and base. The compressed droplets containing acid, base or a combination thereof can be increased in volume in the range of 0.1 percent to 0.4 percent after being decompressed with the decompression device 20. Likewise, the droplets containing acid, base or a combination thereof can be reduced in volume in the range of 0.1 to 0.4 percent after being passed through the compression device 16. For example, the compression device 16 can reduce the volume of the droplets by 0.1 percent when the pressure of the pretreated mixture 14 is increased to 3 MPa and the volume can be reduced by 0.3 percent when the pressure is increased to 7 MPa.

The decompression step can reduce the pressure or decompress the compressed pretreated mixture at a rate that can cause the droplets containing acid, base or a combination thereof to burst explosively into smaller droplets or increase the volume of the droplets to a precompressed state. Without being bound by any particular theory, it is believed that the acid in the smaller burst droplets of the decompressed mixture can react with the non-hydratable phosphatides in the oil and decompose them. The finer dispersion of droplets in the decompressed mixture promotes and enhances the reaction because both reagents, acid and base, are added to the oil in a diluted solution. A very fine dispersion of droplets can enhance the reaction when it has to be substantially completed and the oil requires low residual phosphatides content. Preferably, the dispersion of droplets is so fine that the reaction between the acid and the non-hydratable phosphatides in the oil is substantially instantaneous or at least completed within seconds of the decompression step or steps. A fine dispersion of droplets can also enhance a neutralization reaction with the base. After decompression, the aqueous base droplets can burst to create smaller diameter droplets, which in turn increases the surface interface of the droplets with the oil, and then diffusion distances can decrease and the reaction is enhanced. The decompression step or steps can also promote self-oscillations in the droplets containing acid, base or a combination thereof, which can improve heat and mass transfer processes.

The compressed pretreated mixture 18 can be decompressed in one pass through the decompression device 20. Alternatively, the compressed pretreated mixture 18 can be passed through the decompression device 20 multiple times, such as at least 2, 3, 4, 5, 6, 7 or 8 passes. In another embodiment, one or more decompression devices 20 can be in series to carry out successive decompression steps, such as at least 2, 3, 4, 5, 6, 7 or 8 decompression intervals. Each decompression step or interval or pass can result in a reduction in pressure in the range of 0.1 to 3 MPa, or at least 0.2, 0.4, 0.6, 0.8, 1, 1.2, 1.4, 1.6, 1.8, 2, 2.2, 2.4, 2.6 or 2.8 MPa. Between each decompression step, interval or pass, the decompressed mixture can have a residence period before being subjected to the next decompression. For example, the residence period can be in the range of 0.1 to 3 seconds.

The residence time period can provide time to allow the non-hydratable phospholipids within a lipid matrix of the oil to migrate to an oil-water interface with the droplets. In same time, aqueous acid and base droplets can coalesce, and the interface can decrease, wherein diffusion distances will increase and all this will slow down the mass transfer processes. As such, at least a second explosive decompression step can promote further reaction and can impart additional treatment of the emulsion for reaction completion. Compression and explosive decompression steps can be repeated 2, 3, 4, or 5 and more times if needed. This action promotes gum formation, adsorption of metal-containing compounds and other reactions and processes.

The decompressed mixture 22 can be transferred to a holding tank or container 24 to allow the mixture to settle and, to the extent possible, separate into phases, e.g., oil and water. The holding tank 24 can be used for storing the decompressed mixture 22 for further processing. The decompressed mixture 26 can be sent to one or more separation steps. A separation device, 28, as shown, can be used to separate the gums from the oil. The separation device 28 can be a device known in the art, for example a filter or centrifuge. Preferably, the separation device 28 separates the decompressed mixture 22, 26 into a purified oil 32 and a waste stream 30, such as the aqueous component of the mixture. The oil can be subjected to other processing steps as known in the art, such as bleaching or deodorizing. Such steps can be desirable depending on the intended use of the purified oil product.

In order to promote a further understanding of the invention, the following examples are provided. These examples are shown by way of illustration and not limitation.

Example 1

300 g water degummed soybean oil with a measured residual phosphorus content of 46 ppm was heated to a temperature of approximately 70° C. and mixed with 0.01 weight percent aqueous phosphoric acid (85 wt %) to form an acid/oil emulsion having 0.0085 weight percent phosphoric acid. The acid/oil emulsion was for 2 minutes with a magnetic stirrer and 0.35 weight percent of aqueous caustic soda (9.5 wt %) was added to the acid/oil emulsion to form a pretreated mixture. The pretreated mixture was compressed and subsequently decompressed in three decompression intervals. The compression step included passing the pretreated mixture through a plunger pump to form a compressed mixture having a pressure of 9 MPa. The overall pressure drop after three decompression intervals was 7.88 MPa.

The decompression intervals were carried out with three throttle orifice devices positioned in series and connected to the discharge pipe of the plunger pump. The compressed mixture was decompressed in the first throttle device using an explosive decompression rate was $1.4\times10^6$ MPa per second. The second throttle device, downstream of the first, carried out an explosive decompression at the rate of $3.2\times10^5$ MPa per second. The third throttle device, downstream of the second, carried out an explosive decompression at the rate of $1.1\times10^5$ MPa per second to form a decompressed vegetable oil having a pressure of 1.12 MPa that was further processed to separate the aqueous acid and base to form a degummed vegetable oil. The degummed vegetable oil was analyzed for phosphorus and other trace elements. A residual phosphorus content of 2.3 ppm was measured and the iron, Fe, content had decreased from the initial value of 0.8 ppm to 0.05 ppm. The concentrations of calcium, Ca, had decreased to 2 ppm from 35 ppm and the magnesium, Mg, had decreased to 0 ppm from 8 ppm. Thus, the degumming process resulted in a soybean oil having a 95 percent reduction in phosphorus, a 93.8 percent reduction in iron, a 94.3 percent reduction in calcium and a 100 percent reduction in magnesium.

Example 2

A portion of the pretreated mixture from Example 1 was subjected to a compression step and two consecutive decompression steps in intervals. The compression step was carried out by passing the pretreated mixture through the plunger pump of Example 1 to for a compressed mixture having a pressure of 5.8 MPa. The overall pressure drop after two decompression intervals was 4.87 MPa.

The decompression intervals were carried out with two throttle orifice devices positioned in series and connected to the discharge pipe of the plunger pump. The compressed mixture was decompressed in the first throttle device using an explosive decompression rate was $1.7\times10^6$ MPa per second. The second throttle device, downstream of the first, carried out an explosive decompression at the rate of $7.8\times10^5$ MPa to form a decompressed vegetable oil having a pressure of 0.93 MPa that was further processed to separate the aqueous acid and base to form a degummed vegetable oil.

The degummed vegetable oil was analyzed for phosphorus and other trace elements. A residual phosphorus content of 3.4 ppm was measured and the iron, Fe, content had decreased from the initial value of 0.8 ppm to 0.07 ppm. The concentrations of calcium, Ca, had decreased to 4 ppm from 35 ppm and the magnesium, Mg, had decreased to 2 ppm from 8 ppm. Thus, the degumming process resulted in a soybean oil having a 92.6 percent reduction in phosphorus, a 91.3 percent reduction in iron, a 88.6 percent reduction in calcium and a 75 percent reduction in magnesium.

Example 3

Crude soybean oil with a residual phosphorus content of 530 ppm was mixed with with 0.03 weight percent aqueous phosphoric acid (85 wt %) to form an acid/oil emulsion having 0.0255 weight percent phosphoric acid. The acid/oil emulsion was for 2 minutes with a magnetic stirrer and 0.6 weight percent of aqueous caustic soda (9.5 wt %) was added to the acid/oil emulsion to form a pretreated mixture. The pretreated mixture, at 90° C., was compressed and subsequently decompressed in three intervals. The compression step included passing the pretreated mixture through a plunger pump to form a compressed mixture having a pressure of 3.4 MPa. The overall pressure drop after three decompression intervals was 3.19 MPa.

The decompression intervals were carried out with four throttle orifice devices positioned in series and connected to the discharge pipe of the plunger pump. The compressed mixture was decompressed in the first throttle device using an explosive decompression rate was $4.2\times10^5$ MPa per second. The second throttle device, downstream of the first, carried out an explosive decompression at the rate of $2.8\times10^5$ MPa per second. The third throttle device, downstream of the second, carried out an explosive decompression at the rate of $1.9\times10^5$ MPa per second. The fourth throttle device, downstream of the third, carried out an explosive decompression at the rate of $1.4\times10^5$ MPa per second to form a decompressed vegetable oil having a pressure of 0.21 MPa that was further processed to separate the aqueous acid and base to form a degummed vegetable oil. The degummed vegetable oil was analyzed for phosphorus and other trace elements. A residual phosphorus content of 8 ppm was measured. Thus, the degumming process resulted in a soybean oil having a 98.5 percent reduction in phosphorus.

While various embodiments in accordance with the present invention have been shown and described, it is understood the invention is not limited thereto, and is susceptible to various changes and modifications as known to those skilled in the art. Therefore, this invention is not limited to the details shown and described herein.

What is claimed is:

1. A process for producing emulsions comprising:

a) mixing water and oil to form an emulsion having droplets of the water in the oil;

b) compressing the emulsion to reduce the volume of the droplets containing the water, thereby forming a compressed mixture;

c) decompressing the compressed mixture, said decompressing step carried out in the range of $1\times10^5$ MPa per second to about $3\times10^6$ MPa per second, causing the droplets containing the water to burst into smaller droplets.

2. The process of claim 1, the compressed mixture of step c) being subjected to at least two decompression step intervals, each decompression interval being carried out in the range of $1\times10^5$ MPa per second to about $3\times10^6$ MPa per second.

3. The process of claim 1, the emulsion of step b) being compressed to a pressure of at least 3 MPa and the volume of the droplets containing the water is reduced at least 0.1%.

4. The process of claim 1, the compression step b) being carried out with a compression device having an inlet for receiving the emulsion, the compression device capable of compressing the emulsion into the compressed mixture at least 3 MPa.

5. The process of claim 3, the emulsion being compressed by a plunger, centrifugal or gear pump.

6. The process of claim 1, the oil being a vegetable oil.

7. The process of claim 6, the vegetable oil being a crude oil or water degummed oil.

8. The process of claim 1, the decompression step c) being carried by a throttle device.

9. The process of claim 8, the throttle device being adjustable.

10. The process of claim 8, the throttle device being non-adjustable.

11. The process of claim 8, the throttle device being an orifice, nozzle or pressure loss fluid control device.

12. The process of claim 8, the throttle device being in series.

13. The process of claim 8, the throttle device being in parallel.

14. The process of claim 1, the water in step a) being an aqueous solution.

15. The process of claim 14, the droplets of step b) containing water and acid.

16. The process of claim 14, the droplets of step b) containing water and base.

* * * * *